US012104132B2

(12) United States Patent
Parker et al.

(10) Patent No.: US 12,104,132 B2
(45) Date of Patent: Oct. 1, 2024

(54) FUEL ADDITIVE COMPOSITIONS FOR GASOLINE DIRECT INJECTION ENGINES

(71) Applicant: The Lubrizol Corporation, Wickliffe, OH (US)

(72) Inventors: Garrett Parker, Mentor, OH (US); Stuart L. Bartley, Wickliffe, OH (US); Alexander Michlberger, San Antonio, TX (US); Anthony R. Frank, Painesville, OH (US); Michael D. Nicholls, Twinsburg, OH (US); Adam E. Franczak, Olmsted Falls, OH (US); David L. Spivey, Staffordshire (GB); Alexander Holmes, Belper (GB); George S. Szappanos, Mentor, OH (US); Mark C. Davies, Pudong (CN)

(73) Assignee: The Lubrizol Corporation, Wickliffe, OH (US)

( * ) Notice: Subject to any disclaimer, the term of this patent is extended or adjusted under 35 U.S.C. 154(b) by 53 days.

(21) Appl. No.: 17/779,062

(22) PCT Filed: Nov. 22, 2019

(86) PCT No.: PCT/US2019/050581
§ 371 (c)(1),
(2) Date: May 23, 2022

(87) PCT Pub. No.: WO2021/101496
PCT Pub. Date: May 27, 2021

(65) Prior Publication Data

US 2022/0411705 A1 Dec. 29, 2022

(51) Int. Cl.

| | |
|---|---|
| ***C10L 1/22*** | (2006.01) |
| ***C10L 1/222*** | (2006.01) |
| ***C10L 10/00*** | (2006.01) |

(52) U.S. Cl.
CPC ..... *C10L 1/2222* (2013.01); *C10L 10/00* (2013.01); *C10L 2200/0423* (2013.01); *C10L 2270/023* (2013.01)

(58) Field of Classification Search
CPC ..... C10L 1/2222; C10L 10/00; C10L 2200/0423; C10L 2270/023; C10L 1/1905; C10L 1/198; C10L 1/2225; C10L 1/224; C10L 1/2383; C10L 1/1883
See application file for complete search history.

(56) References Cited

U.S. PATENT DOCUMENTS

| | | | |
|---|---|---|---|
| 2,993,773 A | 7/1961 | Stromberg | |
| 3,148,960 A | 9/1964 | Becker | |
| 3,346,354 A | 10/1967 | Kautsky et al. | |
| 3,687,644 A | 8/1972 | Delafield et al. | |
| 10,119,093 B2 | 11/2018 | Gao et al. | |
| 2008/0202561 A1* | 8/2008 | DuMont | C10L 10/18 510/185 |

FOREIGN PATENT DOCUMENTS

| | | |
|---|---|---|
| EP | 1967567 | 10/2008 |
| EP | 3144371 | 3/2017 |
| WO | 2018/164986 | 9/2018 |
| WO | 2018/178672 | 10/2018 |
| WO | WO2018178674 | * 10/2018 |

OTHER PUBLICATIONS

Kosuke Fujimoto, Satoshi Hirano, & Minoru Yamashita, "Investigation of Engine Oil Effect on Abnormal Combustion in Turbocharged Direct Injection—Spark Ignition Engines", Nov. 3, 2015, pp. 1017-1024, vol. 5, Issue 3, SAE International, Europe.

* cited by examiner

*Primary Examiner* — Cephia D Toomer
(74) *Attorney, Agent, or Firm* — Iken S. Sans; Michael A. Miller

(57) ABSTRACT

Methods of reducing stochastic pre-ignition events and/or carbonaceous deposits in a gasoline-fueled engine by adding at least 10 ppm by weight of a compound having at least one alkyl succinic acid group to a gasoline fuel, wherein said compound is the product of (a) and (b), wherein:
(a) is an amine with at least one tertiary nitrogen, water, or a hydrocarbyl substituted alcohol; and
(b) is a hydrocarbyl-substituted succinic acid and/or anhydride.

16 Claims, No Drawings

FUEL ADDITIVE COMPOSITIONS FOR GASOLINE DIRECT INJECTION ENGINES

This application is a national-phase filing of PCT Application No. PCT/US2019/050581, filed on Nov. 22, 2019.

FIELD OF THE INVENTION

The field of the disclosed technology is generally related to fuel additive compositions having at least one alkyl succinic acid group.

BACKGROUND OF THE INVENTION

In gasoline direct injection ("GDI") engines, a highly-atomized mist of fuel is injected directly into the combustion chamber of each engine cylinder under high pressures, typically between 450 and 3,000 psi. By injecting the fuel directly into the combustion chamber, GDI engines have increased fuel efficiency and higher power output compared to conventional port fuel injection gasoline ("PFI") engines wherein the fuel is directed into a cylinder intake port. This has led to a rapid adoption of GDI engines in the automotive industry.

The fuel injectors of GDI engines are prone to carbon build-up or "deposits" because of the injectors' proximity to the combustion chamber. These deposits can affect the spray pattern of fuel passing through the nozzle of the injector and reduce the amount of fuel entering into the combustion chamber.

In certain situations, GDI engines may exhibit abnormal combustion. Abnormal combustion in a spark-initiated internal combustion engine may be understood as an uncontrolled explosion occurring in the combustion chamber as a result of ignition of combustible elements therein by a source other than the igniter.

Pre-ignition may be understood as an abnormal form of combustion resulting from ignition of the air-fuel mixture prior to ignition by the igniter. Anytime the air-fuel mixture in the combustion chamber is ignited prior to ignition by the igniter, such may be understood as pre-ignition.

Without being bound to a particular theory, traditionally, pre-ignition has occurred during high speed operation of an engine when a particular point within the combustion chamber of a cylinder may become hot enough during high speed operation of the engine to effectively function as a glow plug (e.g. overheated spark plug tip, overheated burr of metal) to provide a source of ignition which causes the air-fuel mixture to ignite before ignition by the igniter. Such pre-ignition may be more commonly referred to as hot-spot pre-ignition and may be inhibited by simply locating the hot spot and eliminating it.

More recently, vehicle manufacturers have observed intermittent abnormal combustion in their production of turbocharged gasoline engines. These are known as stochastic pre-ignition ("SPI") events. These SPI events can occur at engine speed or load but is frequently observed at low speeds and medium-to-high loads. More particularly, when operating the engine at speeds less than or equal to 3,000 rpm and under a load with a break mean effective pressure ("BMEP") of greater than or equal to 10 bars, a condition which may be referred to as low-speed pre-ignition ("LSPI") may occur in a very random and stochastic fashion.

Detergents, such as Mannich compounds, polyetheramines, and/or polyisobutyl amines ("PIB-amines") are added to gasoline fuels to help keep injectors clean ("keep-clean") or remove deposit build-up ("clean-up") in the injectors and elsewhere in the engine.

SUMMARY OF THE INVENTION

The disclosed technology provides compounds and methods for reducing, inhibiting, or even eliminating SPI events in gasoline-fueled engines by operating the engines on a fuel that contains a compound having at least one alkyl succinic acid group.

It was found that these compounds, when added to fuels were surprisingly effective at reducing the number or mitigation the effects of SPI events. Accordingly, methods of reducing stochastic events in a gasoline-fueled engine are disclosed. The methods comprise adding at least 10 ppm of a compound having at least one alkyl succinic acid group to a gasoline fuel, wherein said compound is the product of (a) and (b), wherein: (a) is an amine with at least one tertiary nitrogen, water, or a hydrocarbyl substituted alcohol; and (b) is a hydrocarbyl-substituted succinic acid and/or anhydride. The molar ratio of (a) to (b) may range from 3:1 to 1:3.

In some embodiments, at least a portion of the compound may have the formula (I):

(I)

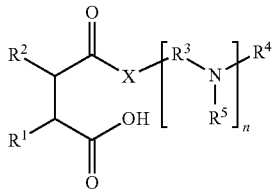

wherein $R^1$ and $R^2$ are independently hydrogen or a $C_1$ to $C_{50}$ linear or branched hydrocarbyl group; $R^3$ is a $C_1$ to $C_5$ linear or branched hydrocarbyl group; $R^4$ and $R^5$ are independently hydrogen or a $C_1$ to $C_{22}$ linear or branched hydrocarbyl group, or are moieties which, when taken together form a 5-, 6-, or 7-membered ring; n is 0 to 5; X is O or $NR^6$; and $R^6$ is hydrogen, a $C_1$ to $C_{50}$ linear or branched hydrocarbyl group, or $—(R^7R^8NH)_mR^9$, wherein $R^7$ is a $C_1$ to $C_5$ linear or branched hydrocarbyl group; $R^8$ and $R^9$ are independently hydrogen or a $C_1$ to $C_{22}$ linear or branched hydrocarbyl group, or are moieties which, when taken together form a 5-, 6-, or 7-membered ring; and m is 0 to 5.

In other embodiments, at least a portion of the compound may be an ester that is the product of (a) and (b), wherein:

(a) is an amine with (i) at least one tertiary nitrogen and (ii) at least one hydroxy alkyl functionality and/or at least one secondary amine functionality;

(b) is a hydrocarbyl-substituted succinic acid and/or anhydride; and wherein said ester has the formula (II):

(II)

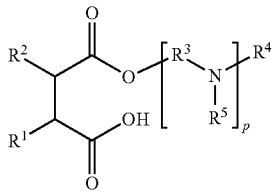

wherein $R^1$ and $R^2$ are independently hydrogen or a $C_1$ to $C_{50}$ linear or branched hydrocarbyl group; $R^3$ is $C_1$ to $C_5$ linear or branched hydrocarbyl group; $R^4$ and $R^5$ are independently hydrogen or a $C_1$ to $C_{22}$ linear or branched hydrocarbyl group, or are moieties which, when taken together form a 5-, 6-, or 7-membered ring; and p is 1 to 5.

In yet another embodiment, at least a portion of the compound may be an amide that is the product of (a) and (b), wherein:

(a) is a diamine or polyamine with (i) at least one tertiary nitrogen and (ii) at least one primary or secondary amine functionality; and (b) is a hydrocarbyl-substituted succinic acid and/or anhydride; and wherein said amine has the formula (III):

(III)

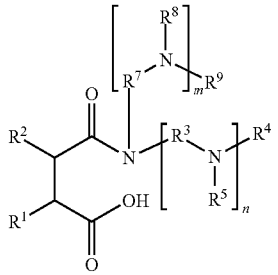

wherein $R^1$ and $R^2$ are independently hydrogen or a $C_1$ to $C_{50}$ linear or branched hydrocarbyl group; $R^3$ is a $C_1$ to $C_5$ linear or branched hydrocarbyl group; $R^4$ and $R^5$ are independently hydrogen or a $C_1$ to $C_{22}$ linear or branched hydrocarbyl group, or are moieties which, when taken together form a 5-, 6-, or 7-membered ring; n is 0 to 5; X is O or $NR^6$; and $R^6$ is hydrogen, a $C_1$ to $C_{50}$ linear or branched hydrocarbyl group, or —$(R^7R^8NH)_mR^9$, wherein $R^7$ is a $C_1$ to $C_5$ linear or branched hydrocarbyl group; $R^8$ and $R^9$ are independently hydrogen or a $C_1$ to $C_{22}$ linear or branched hydrocarbyl group, or are moieties which, when taken together form a 5-, 6-, or 7-membered ring, and m is 0 to 5. In other embodiments, at least one of m and n is not 0. In yet other embodiments, both m and n are 0.

In some embodiments, at least a portion of the compound may be an acid that is the product of (a) and (b), wherein:

(a) is water or a hydrocarbyl-substituted alcohol; and (b) is a hydrocarbyl-substituted succinic acid and/or anhydride; and wherein said acid has the formula (IV):

(IV)

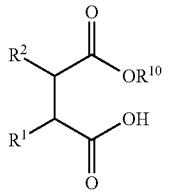

wherein $R^1$ and $R^2$ are independently hydrogen or a $C_1$ to $C_{50}$ linear or branched hydrocarbyl group; and $R^{10}$ is a $C_1$ to $C_{22}$ linear or branched hydrocarbyl group. In some in embodiments, the compound may be a dicarboxylic acid wherein $R^{10}$ is hydrogen.

In some embodiments, the hydrocarbyl-substituted succinic acid and/or anhydride thereof, wherein the acid comprises at least one acid of formula (I), (II), (III), (IV), or combinations thereof. In some embodiments, $R^1$ and $R^2$ in any formula (I), (II), (III), or (IV), may be are independently hydrogen or a $C_8$ to $C_{25}$ or $C_{12}$ to $C_{16}$ hydrocarbyl group. In some embodiments, at least one of $R^1$ and $R^2$ is hydrogen. In some embodiments, the compound mat be the product of N,N-dimethylethanolamine and hexadecenylsuccinic anhydride. In other embodiments, the compound may be the product of N1-(3-(dimethylamino)propyl)-N3,N3-dimethylpropane-1,3-diamine and hexadecenylsuccinic anhydride.

In yet other embodiments, the amine may be an alkoxylated fatty amine. Alternatively, the gasoline fuel may further comprise an alkoxylated fatty amine in addition to the amine used to make the compound. The alkoxylated fatty amine may have the formula (V):

(V)

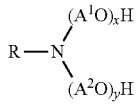

wherein R is a $C_4$ to $C_{30}$ hydrocarbyl group; $A^1$ and $A^2$ are individually a $C_1$ to $C_{10}$ alkylene group; and the sum of x and y is an integer of at least 1.

The compound may have a concentration of at least 12 ppm, 25 ppm, or 50 ppm, based on a total weight of the gasoline fuel. The gasoline fuel may comprise 0.1 vol % to 100 vol % oxygenate, based on a total volume of the gasoline fuel. Alternatively, the gasoline fuel may comprise 0.1 vol % to 100 vol % gasoline, based on a total volume of said gasoline fuel. In some embodiments, the oxygenate may be ethanol.

The engine may be an internal combustion gasoline engine, such as, but not limited to, a gasoline direct injection ("GDI") engine, a port fuel injection ("PFI") engine, a homogeneous charge compression ignition ("HCCI") engine, or a combination thereof. In some method embodiments, the compound may be added to a gasoline fuel using an onboard dosing system.

Also disclosed herein are uses of a compound having at least one alkyl succinic acid group, in a gasoline fuel to reduce stochastic pre-ignition events and/or carbonaceous deposits in an engine. The compound may be described as above, namely it may be the product of (a) and (b), wherein: (a) is an amine with at least one tertiary nitrogen, water, or a hydrocarbyl substituted alcohol; and (b) is a hydrocarbyl-substituted succinic acid and/or anhydride. In some embodiments, the engine may be an internal combustion gasoline engine, such as but not limited to, a gasoline direct injection ("GDI") engine, a port fuel injection ("PFI") engine, a homogeneous charge compression ignition ("HCCI") engine, or a combination thereof.

DETAILED DESCRIPTION OF THE INVENTION

Various features and embodiments will be described below by way of non-limiting illustrations. In one embodiment, a fuel composition comprising at least 10 ppm by weight of a compound having at least one alkyl succinic acid group to a fuel composition is disclosed. The compound is the product of (a) and (b), wherein: (a) is (i) an amine with at least one tertiary nitrogen, (ii) water, or (iii) an alcohol; and (b) is a hydrocarbyl-substituted succinic acid/or anhydride. The molar ratio of (a) to (b) may range from 3:1 to 1:3. The fuel composition may comprise gasoline, oxygenate, or mixtures thereof.

As used herein, the terms "hydrocarbyl", "hydrocarbyl substituent" or "hydrocarbyl group" are used in their ordinary sense, which is well-known to those skilled in the art. Specifically, the terms refer to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two, or no more than one, non-hydrocarbon substituent will be present for every ten carbon atoms in the hydrocarbyl group; alternatively, there may be no non-hydrocarbon substituents in the hydrocarbyl group.

In one embodiment, at least a portion of the compound has the formula (I):

(I)

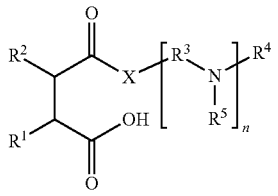

wherein $R^1$ and $R^2$ are independently hydrogen or a $C_1$ to $C_{50}$ linear or branched hydrocarbyl group; $R^3$ is a $C_1$ to $C_5$ linear or branched hydrocarbyl group; $R^4$ and $R^5$ are independently hydrogen or a $C_1$ to $C_{22}$ linear or branched hydrocarbyl group, or are moieties which, when taken together form a 5-, 6-, or 7-membered ring; n is 0 to 5; X is O or $NR^6$; and $R^6$ is hydrogen, a $C_1$ to $C_{50}$ linear or branched hydrocarbyl group, or —$(R^7R^8NH)_mR^9$, wherein $R^7$ is a $C_1$ to $C_5$ linear or branched hydrocarbyl group; $R^8$ and $R^9$ are independently hydrogen or a $C_1$ to $C_{22}$ linear or branched hydrocarbyl group, or are moieties which, when taken together form a 5-, 6-, or 7-membered ring; and m is 0 to 5. In yet another embodiment, the compound may be the product of N,N-methyldiethanolamine and N-hexadecenylsuccinic anhydride.

In another embodiment, at least a portion of the compound is an ester that is the product of (a) and (b), wherein: (a) is an amine with (i) at least one tertiary nitrogen and (ii) at least one hydroxy alkyl functionality and/or at least one secondary amine functionality. In one embodiment, the ester compound has the formula (II):

(II)

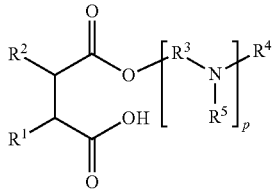

wherein $R^1$ and $R^2$ are independently hydrogen or a $C_1$ to $C_{50}$ linear or branched hydrocarbyl group; $R^3$ is $C_1$ to $C_5$ linear or branched hydrocarbyl group; $R^4$ and $R^5$ are independently hydrogen or a $C_1$ to $C_{22}$ linear or branched hydrocarbyl group, or are moieties which, when taken together form a 5-, 6-, or 7-membered ring; and p is 1 to 5.

In yet another embodiment, at least a portion of the compound is an amide that is the product of (a) and (b), wherein: (a) is a diamine or polyamine with (i) at least one tertiary nitrogen and (ii) at least one primary or secondary amine functionality; and (b) is a hydrocarbyl-substituted succinic acid and/or anhydride. In another embodiment, the amine has the formula (III):

(III)

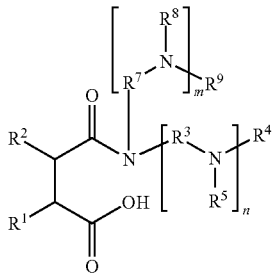

wherein $R^1$ and $R^2$ are independently hydrogen or a $C_1$ to $C_{50}$ linear or branched hydrocarbyl group; $R^3$ is a $C_1$ to $C_5$ linear or branched hydrocarbyl group; $R^4$ and $R^5$ are independently hydrogen or a $C_1$ to $C_{22}$ linear or branched hydrocarbyl group, or are moieties which, when taken together form a 5-, 6-, or 7-membered ring; n is 0 to 5; X is O or $NR^6$; and $R^6$ is hydrogen, a $C_1$ to $C_{50}$ linear or branched hydrocarbyl group, or —$(R^7R^8NH)_mR^9$, wherein $R^7$ is a $C_1$ to $C_5$ linear or branched hydrocarbyl group; $R^8$ and $R^9$ are independently hydrogen or a $C_1$ to $C_{22}$ linear or branched hydrocarbyl group, or are moieties which, when taken together form a 5-, 6-, or 7-membered ring, and m is 0 to 5. In some embodiments, at least one of m and n is not 0. In yet other embodiments, wherein both m and n are 0.

In another embodiment, at least a portion of the of the compound is an amine that may have the formula (VI):

(VI)

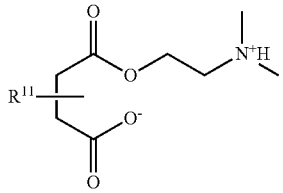

wherein $R^{11}$ is hydrogen or a $C_1$ to $C_{50}$ linear or branched hydrocarbyl group. In one embodiment, $R^{11}$ is a $C_{12}$ to $C_{20}$ linear or branched hydrocarbyl group. In yet another embodiment, $R^{11}$ is a $C_{16}$ linear hydrocarbyl group. It yet other embodiments, the compound may comprise the product of hexadecenylsuccinic anhydride ("HDSA") and N,N-dimethylethanolamine (N,N-dimethylaminoethanol).

In another embodiment, at least a portion of the compound may have the formula (VII):

(VII)

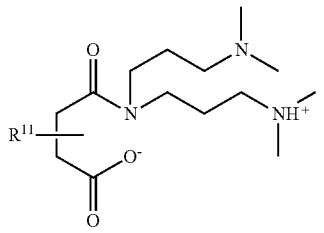

wherein $R^{11}$ is hydrogen or a $C_1$ to $C_{50}$ linear or branched hydrocarbyl group. In one embodiment, $R^{11}$ is a $C_{12}$ to $C_{20}$ linear or branched hydrocarbyl group. In yet another embodiment, $R^{11}$ is a $C_{16}$ linear hydrocarbyl group. It yet other embodiments, the compound may comprise the product of hexadecenylsuccinic anhydride ("HDSA") and N1-(3-(dimethylamino)propyl)-N3,N3-dimethylpropane-1,3-diamine.

In yet other embodiments, the amine may have the formulas above, wherein $R^{11}$ may be a linear or branched $C_8$ to $C_{25}$ hydrocarbyl group. Exemplary hydrocarbyl groups include, but are not limited to, $C_8$ to $C_{18}$, $C_{10}$ to $C_{16}$, or $C_{13}$ to $C_{17}$, linear or branched hydrocarbyl groups. In one embodiment, $R^{11}$ may be a linear or branched $C_{12}$ to $C_{16}$ hydrocarbyl group. In one embodiment, $R^{11}$ may be dodecyl or hexadecyl group. In yet another embodiment, $R^{11}$ may be a linear dodecyl or linear hexadecyl group. In yet other embodiments, $R^{11}$ may be a polyisobutylene ("PIB") group having a number average molecular weight ("$M_n$") of 250 to 650, or 350 to 550.

The Amine With at Least One Tertiary Nitrogen

Amines suitable for making the compound are not overly limited provided the amine with at least one tertiary nitrogen. In some embodiments, the amine may have at least one hydroxyl alkyl functionality and/or at least one secondary amine functionality in addition to the at least one tertiary nitrogen. As used herein "functionality" can be interchanged with "functional group". The amines may be mono-, di-, or polyamines, and include cyclic amines. For monoamines, the amine will be tertiary and have at least one hydroxyl alkyl functional group. If the amine is a diamine, one nitrogen must be tertiary and the other must be secondary. If the amine is a polyamine, at least one nitrogen is tertiary and at least one nitrogen is secondary, and the remaining nitrogens may be secondary, tertiary, or a combination thereof. The polyamine may or may not have at least one hydroxyl alkyl functional group. Exemplary amines include, but are not limited to, triethanolamine, N,N-dimethylaminopropanol, N,N-diethylaminopropanol, N,N-diethylaminobutanol, triisopropanolamine, 1-[2-hydroxyethyl]piperidine, 1-[2-hydroxyethyl]piperazine, 1-[2-hydroxyethyl]-4-hydrocarbylpiperazine 1,4-bis[2-hydroxyethyl]piperazine 4-[2-hydroxyethyl]morpholine, 2-[2-(dimethylamine)ethoxy]-ethanol, N-ethyldiethanolamine, N-methyldiethanolamine, N-butyldiethanolamine, N,N-diethylaminoethanol, N,N-dimethylaminoethanol, 2-dimethylamino-2-methyl-1-propanol, and N1-(3-(dimethylamino)propyl)-N3,N3-dimethylpropane-1,3-diamine.

Additional amines suitable for making the amines include alkoxylated fatty amines, for example polyethoxylated tallow amine. The alkoxylated fatty amines may have the formula (V):

(V)

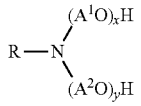

wherein R is a $C_4$ to $C_{30}$ hydrocarbyl group; $A^1$ and $A^2$ are individually a $C_1$ to $C_{10}$ alkylene group; and the sum of x and y is an integer of at least 1.

The Hydrocarbyl-Substituted Succinic Acid or Anhydride

The hydrocarbyl-substituted succinic acids and anhydrides suitable for making the disclosed compounds include dimer acids. Dimer acids are a type of di-acid polymer derived from fatty acids and/or polyolefins and include polyalkenes containing acid functionality. In some embodiments, the dimer acid is derived from $C_{10}$ to $C_{20}$ polyolefins, $C_{12}$ to $C_{18}$ polyolefins, and/or $C_{16}$ to $C_{18}$ polyolefins.

The hydrocarbyl group of the hydrocarbyl-substituted succinic acid or anhydride generally contains an average of at least about 8, or about 30, or about 35 up to about 350, or to about 200, or to about 100 carbon atoms. In one embodiment, the hydrocarbyl group is derived from a polyalkene.

The polyalkene may be characterized by a $M_n$(number average molecular weight) of at least about 300. Generally, the polyalkene is characterized by an $M_n$ of about 500, or about 700, or about 800, or even about 900 up to about 5000, or to about 2500, or to about 2000, or even to about 1500. In another embodiment, n varies between about 300, or about 500, or about 700 up to about 1200 or to about 1300.

As used herein, the number average molecular weight ($M_n$) is measured using gel permeation chromatography ("GPC") (Waters GPC 2000) based on polystyrene standards. The instrument is equipped with a refractive index detector and Waters Empower™ data acquisition and analysis software. The columns are polystyrene (PLgel, 5 micron, available from Agilent/Polymer Laboratories, Inc.). For the mobile phase, individual samples are dissolved in tetrahydrofuran and filtered with PTFE filters before they are injected into the GPC port.

Waters GPC 2000 Operating Conditions:

Injector, Column, and Pump/Solvent compartment temperatures: 40° C.

Autosampler Control: Run time: 40 minutes

Injection volume: 300 microliter

Pump: System pressure: ~90 bars (Max. pressure limit: 270 bars, Min. pressure limit: 0 psi)

Flow rate: 1.0 ml/minute

Differential Refractometer (RI): Sensitivity: −16; Scale factor: 6

The polyalkenes include homopolymers and interpolymers of polymerizable olefin monomers of 2 to about 16 or to about 6, or to about 4 carbon atoms. The olefins may be monoolefins such as ethylene, propylene, 1-butene, isobutene, and 1-octene; or a polyolefinic monomer, such as diolefinic monomer, such 1,3-butadiene and isoprene. In one embodiment, the interpolymer is a homopolymer. An example of a polymer is a polybutene. In one instance about 50% of the polybutene is derived from isobutylene. The polyalkenes are prepared by conventional procedures.

In one embodiment, the hydrocarbyl groups are derived from polyalkenes having an $M_n$ of about 200 to at least about 1300, or about 1500, or about 1600 up to about 5000, or to about 3000, or to about 2500, or to about 2000, or to about 1800, and the $Mw/M_n$ is from about 1.5 or about 1.8, or about 2, or to about 2.5 to about 3.6, or to about 3.2. In some embodiments the polyalkene is polyisobutylene with a molecular weight of 200 to 550. In yet another embodiment the polyalkene is N-hexadecenylsuccinic anhydride ("HDSA") having an $M_n$ of about 225.

In one embodiment, the hydrocarbyl-substituted succinic acids and anhydrides may be prepared by reacting the above described polyalkene with an excess of maleic anhydride to provide substituted succinic compounds wherein the number of succinic groups for each equivalent weight of substituent group is at least 1.3, or to about 1.5, or to about 1.7, or to about 1.8. The maximum number generally will not exceed 4.5, or to about 2.5, or to about 2.1, or to about 2.0.

In another embodiment, the hydrocarbyl group contains an average from about 8, or about 10, or about 12 up to about 40, or to about 30, or to about 24, or to about 20 carbon atoms. In one embodiment, the hydrocarbyl group contains an average of 16 to 18 carbon atoms. In another embodiment, the hydrocarbyl group is a tetrapropenyl group. In one embodiment, the hydrocarbyl group is an alkenyl group.

The hydrocarbyl group may be derived from one or more olefins having from about 2 to about 40 carbon atoms or oligomers thereof. These olefins are preferably alpha-olefins (sometimes referred to as mono-1-olefins) or isomerized alpha-olefins. Examples of the alpha-olefins include ethylene, propylene, butylene, 1-octene, 1-nonene, 1-decene, 1-dodecene, 1-tridecene, 1-tetradecene, 1-penta-decene, 1-hexadecene, 1-heptadecene, 1-octadecene, 1-nonadecene, 1-eicosene, 1-henicosene, 1-docosene, 1-tetracosene, etc. Commercially available alpha-olefin fractions that may be used include the $C_{15-18}$ alpha-olefins, $C_{12-16}$ alpha-olefins, $C_{14-16}$ alpha-olefins, $C_{14-18}$ alpha-olefins, $C_{16-18}$ alpha-olefins, $C_{16-20}$ alpha-olefins, $C_{22-28}$ alpha-olefins, etc. In one embodiment, the olefins are $C_{16}$ and $C_{16-18}$ alpha-olefins. Additionally, $C_{30}$+ alpha-olefin fractions such as those available from Gulf Oil Company under the name Gulftene can be used. In one embodiment, the olefin monomers include ethylene, propylene and 1-butene.

Isomerized alpha-olefins are alpha-olefins that have been converted to internal olefins. The isomerized alpha-olefins suitable for use herein are usually in the form of mixtures of internal olefins with some alpha-olefins present. The procedures for isomerizing alpha-olefins are well known to those in the art. Briefly, these procedures involve contacting alpha-olefin with a cation exchange resin at a temperature in a range of about 80 to about 130° C. until the desired degree of isomerization is achieved.

The mono-olefins may be derived from the cracking of paraffin wax. The wax cracking process yields both even and odd number $C_{6-20}$ liquid olefins of which 85% to 90% are straight chain 1-olefins. The balance of the cracked wax olefins is made up of internal olefins, branched olefins, diolefins, aromatics and impurities. Distillation of the $C_{6-20}$ liquid olefins, obtained from the wax cracking process, yields fractions (e.g., $C_{15-18}$ alpha-olefins) which are useful in preparing the succinic acylating agents.

Other mono-olefins can be derived from the ethylene chain growth process. This process yields even numbered straight-chain 1-olefins from a controlled Ziegler polymerization. Other methods for preparing the mono-olefins include chlorination-dehydrochlorination of paraffin and catalytic dehydrogenation of paraffins.

The succinic acids and anhydrides may be prepared by reacting the above-described olefins, isomerized olefins or oligomers thereof with unsaturated carboxylic acylating agents, such as itaconic, citraconic, or maleic acylating agents at a temperature of about 160°, or about 185° C. up to about 240° C., or to about 210° C. The procedures for preparing the acylating agents are well known to those skilled in the art.

In one embodiment, the alkenyl group is derived from oligomers of lower olefins, i.e., olefins containing from 2 to about 6, or about 4 carbon atoms. Examples of these olefins include ethylene, propylene and butylene.

The olefin, olefin oligomer, or polyalkene may be reacted with the carboxylic reagent such that there is at least one mole of carboxylic reagent for each mole of olefin, olefin oligomer, or polyalkene that reacts. An excess of carboxylic reagent may be used. In one embodiment, this excess is between about 5% to about 25%. In another embodiment, the excess is greater than 40%, or greater than 50%, and even greater than 70%.

The conditions, i.e., temperature, agitation, solvents, and the like, for forming the hydrocarbyl-substituted succinic acylating agent, are known to those in the art.

In some embodiments the hydrocarbyl substituted succinic acids or anhydrides contain di-acid functionality. In other embodiments, which may be used alone or in combination with the embodiments described above, the hydrocarbyl group of the hydrocarbyl substituted succinic acid or anhydride is derived from polyisobutylene and the di-acid functionality of the agent is derived from carboxylic acid groups, such as hydrocarbyl substituted succinic acid.

In some embodiments the hydrocarbyl substituents of the substituted succinic acids or anhydrides described above are derived from homopolymers and/or copolymers containing 2 to 10 carbon atoms. In some embodiments the hydrocarbyl substituents are derived from polyisobutylene. In yet other embodiments, the hydrocarbyl substituents are derived from N-hexadecenylsuccinic anhydride.

Organic Solvent

In one embodiment, the fuel composition further comprises (c) an organic solvent. The organic solvent may be added to the disclosed compounds or be included in a fuel additive package comprising the disclosed compounds, the organic solvent, and other fuel additives. The organic solvent may provide for a homogeneous and liquid compound for use as an additive composition and/or fuel additive package that facilitates handling. The organic solvent may also provide for a homogeneous fuel composition comprising gasoline and the additive composition.

In some embodiments, the organic solvent may be an aliphatic or aromatic hydrocarbon. These types of organic solvents generally boil in the range of about 65° C. to 235° C. Aliphatic hydrocarbons include various naphtha and kerosene boiling point fractions that have a majority of aliphatic components. Aromatic hydrocarbons include benzene, toluene, xylenes and various naphtha and kerosene boiling point fractions that have a majority of aromatic components. Additional organic solvents include aromatic hydrocarbons and mixtures of alcohols with aromatic hydrocarbons or kerosene having enough aromatic content that allows the additive composition to be a fluid at a temperature from about 0° C. to minus 18° C. The aliphatic or aromatic hydrocarbon may be present at about 0 to 70 wt %, 0 to 50 wt %, 0 to 40 wt %, 0 to 35 wt %, or 0 to 30 wt %, based on a total weight of the compound and/or additive package.

In some embodiments, the organic solvent may be an alcohol. Alcohols can be aliphatic alcohols having about 2 to 16 or 2 to 10 carbon atoms. In one embodiment, the alcohol can be ethanol, 1-propanol, isopropyl alcohol, 1-butanol, isobutyl alcohol, amyl alcohol, isoamyl alcohol, 2-methyl-1-butanol, and 2-ethylhexanol. The alcohol can be present in the additive composition at about 0 to 40 wt %, 0 to 30 wt %, or 0 to 20 wt %, based on total weight of the compound and/or additive package.

The organic solvent may comprise at least one of 2-ethylhexanol, naphtha, dimethylbenzene ("xylene"), or mixtures thereof. Naphtha can include heavy aromatic naphtha ("HAN"). Accordingly, in one embodiment, the organic solvent may comprise at least one of 2-ethylhexanol, naphtha, dimethylbenzene, or mixtures thereof.

Fuel

The fuel composition comprises a fuel which is liquid at room temperature and is useful in fueling an engine. The fuel is normally a liquid at ambient conditions e.g., room temperature (20 to 30° C.). The fuel can be a hydrocarbon fuel, a nonhydrocarbon fuel, or a mixture thereof. The hydrocarbon fuel can be a hydrocarbon prepared by a gas to liquid process to include for example hydrocarbons prepared by a process such as the Fischer-Tropsch process. The hydrocarbon fuel can be a petroleum distillate to include a gasoline as defined by ASTM specification D4814. In one embodiment the fuel is a gasoline, and in other embodiments the fuel is a leaded gasoline or a nonleaded gasoline. The nonhydrocarbon fuel can be an oxygen containing composition, often referred to as an oxygenate, to include an alcohol, an ether, a ketone, an ester of a carboxylic acid, a nitroalkane, or a mixture thereof. The nonhydrocarbon fuel can include, for example, methanol, ethanol, butanol, methyl t-butyl ether, methyl ethyl ketone. In several embodiments, the fuel can have an oxygenate content on a volume basis that is 1 percent by volume, or 10 percent by volume, or 50 percent by volume, or up to 85 percent by volume. In yet other embodiments, the fuel can have an oxygenate content of essentially 100 percent by volume (minus any impurities or contaminates, such as water). Mixtures of hydrocarbon and nonhydrocarbon fuels can include, for example, gasoline and methanol and/or ethanol. The ethanol may be a fuel-grade ethanol according to ASTM D4806. In various embodiments, the liquid fuel can be an emulsion of water in a hydrocarbon fuel, a nonhydrocarbon fuel, or a mixture thereof.

The fuel may comprise gasoline, oxygenate, or mixtures thereof. In one embodiment, the fuel composition may comprise 0.1 vol % to 100 vol % oxygenate, based on a total volume of the fuel composition. In yet another embodiment, the fuel composition may comprise 0.1 vol % to 100 vol % gasoline, based on a total volume of the fuel composition. In yet another embodiment, the oxygenate may be ethanol. In other embodiments, the fuel composition may comprise gasoline and 5 vol % to 30 vol % ethanol.

Additional Performance Additives

The fuel compositions described above can further comprise one or more additional performance additives. These additional performance additives can be based on several factors such as the type of internal combustion engine and the type of fuel being used in that engine, the quality of the fuel, and the service conditions under which the engine is being operated. The additional performance additives can include an antioxidant such as a hindered phenol or derivative thereof and/or a diarylamine or derivative thereof, a corrosion inhibitor such as an alkenylsuccinic acid, including PIB succinic acid, and/or a detergent/dispersant additive such as a polyetheramine or nitrogen containing detergent, including but not limited to PIB amine dispersants, Mannich dispersants, quaternary salt dispersants, and succinimide dispersants.

Further additives can include, dyes, bacteriostatic agents and biocides, gum inhibitors, marking agents, and demulsifiers, such as polyalkoxylated alcohols. Other additives can include lubricity agents, such as fatty carboxylic acids, metal deactivators such as aromatic triazoles or derivatives thereof, and valve seat recession additives such as alkali metal sulfosuccinate salts. Additional additives can include, antistatic agents, de-icers, and combustion improvers such as an octane or cetane improver.

Fluidizer

In one embodiment, the additional additives can comprise fluidizers such as mineral oil and/or poly(alpha-olefins) and/or polyethers. In another embodiment, the fluidizer can be a polyetheramine. In another embodiment, the polyetheramine can be a detergent. The polyetheramine can be represented by the formula $R[OCH_2CH(R^1)]nA$, where R is a hydrocarbyl group, $R^1$ is selected from the group consisting of hydrogen, hydrocarbyl groups of 1 to 16 carbon atoms, and mixtures thereof, n is a number from 2 to about 50, and A is selected from the group consisting of $—OCH_2CH_2CH_2NR^2R^2$ and $—NR^3R^3$, where each $R^2$ is independently hydrogen or hydrocarbyl, and each $R^3$ is independently hydrogen, hydrocarbyl or $—[R^4N(R^5)]pR^6$, where $R^4$ is $C_2$-$C_{10}$ alkylene, $R^5$ and $R^6$ are independently hydrogen or hydrocarbyl, and p is a number from 1-7. These polyetheramines can be prepared by initially condensing an alcohol or alkylphenol with an alkylene oxide, mixture of alkylene oxides or with several alkylene oxides in sequential fashion in a 1:2-50 mole ratio of hydric compound to alkylene oxide to form a polyether intermediate. U.S. Pat. No. 5,094,667 provides reaction conditions for preparing a polyether intermediate, the disclosure of which is incorporated herein by reference. In one embodiment, the alcohols can be linear or branched from 1 to 30 carbon atoms, in another embodiment 6 to 20 carbon atoms, in yet another embodiment from 10 to 16 carbon atoms. The alkyl group of the alkylphenols can be 1 to 30 carbon atoms, in another embodiment 10 to 20 carbon atoms. Examples of the alkylene oxides include ethylene oxide, propylene oxide or butylene oxide. The number of alkylene oxide units in the polyether intermediate can be 10-35 or 18-27. The polyether intermediate can be converted to a polyetheramine by amination with ammonia, an amine or a polyamine to form a polyetheramine of the type where A is $—NR^3R^3$. Published Patent Application EP310875 provides reaction conditions for the amination reaction, the disclosure of which is incorporated herein by reference. Alternately, the polyether intermediate can also be converted to a polyetheramine of the type where A is $—OCH_2CH_2CH_2NR^2R^2$ by reaction with acrylonitrile followed by hydrogenation. U.S. Pat. No. 5,094,667 provides reaction conditions for the cyanoethylation and subsequent hydrogenation, the disclosure of which is incorporated herein by reference. Polyetheramines where A is $—OCH_2CH_2CH_2NH_2$ are typically preferred. Commercial examples of polyetheramines are the Techron™ range from Chevron and the Jeffamine™ range from Huntsman.

In another embodiment, the fluidizer can be a polyether, which can be represented by the formula $R^7O[CH_2CH(R^8)O]qH$, where $R^7$ is a hydrocarbyl group, $R^8$ is selected from the group consisting of hydrogen, hydrocarbyl groups of 1 to 16 carbon atoms, and mixtures thereof, and q is a number from 2 to about 50. Reaction conditions for preparation as well as various embodiments of the polyethers are presented above in the polyetheramine description for the polyether intermediate. A commercial example of a polyether is the Lyondell ND™ series. Other suitable polyethers are also available from Dow Chemicals, Huntsman, and Akzo.

In yet another embodiment, the fluidizer can be a hydrocarbyl-terminated poly-(oxyalklene) aminocarbamate as described U.S. Pat. No. 5,503,644.

In yet another embodiment, the fluidizer can be an alkoxylate, wherein the alkoxylate can comprise: (i) a polyether containing two or more ester terminal groups; (ii) a polyether containing one or more ester groups and one or more terminal ether groups; or (iii) a polyether containing one or more ester groups and one or more terminal amino groups wherein a terminal group is defined as a group located within five connecting carbon or oxygen atoms from the end of the polymer. Connecting is defined as the sum of the connecting carbon and oxygen atoms in the polymer or end group.

An alkoxylate can be represented by the formula (VIII):

(VIII)

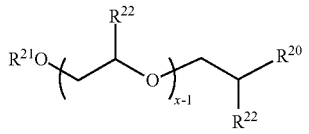

wherein, $R^{21}$ is TC(O)— wherein T is a hydrocarbyl derived from tallow fatty acid; $R^{20}$ is OH, A, WC(O)—, or mixtures thereof, wherein A is —$OCH_2CH_2CH_2NR^{23}R^{23}$ or —$NR^{24}R^{24}$, where each $R^{23}$ is independently hydrogen or hydrocarbyl, and each $R^{24}$ is independently hydrogen, hydrocarbyl or —$[R^{25}N(R^{26})]pR^{26}$ where $R^{25}$ is $C_{2-10}$-alkylene, each $R^{26}$ is independently hydrogen or hydrocarbyl, and p is a number from 1-7, W is a $C_{1-36}$ hydrocarbyl group; $R^{22}$ is H, —$CH_3$, —$CH_2CH_3$ or mixtures thereof; and X is an integer from 1 to 36.

Examples of the alkoxylate can include: $C_{12-15}$ alcohol initiated polypropyleneoxide (22-24) ether amine, Bayer ACTACLEAR ND21-A™ ($C_{12-15}$ alcohol initiated polypropyleneoxide (22-24) ether-ol), tall oil fatty acid initiated polypropyleneoxide (22-24) ester-ol, butanol initiated polypropyleneoxide (23-25) ether-tallow fatty acid ester, glycerol dioleate initiated polypropyleneoxide (23-25) ether-ol, propylene glycol initiated polypropyleneoxide (33-34) ether tallow fatty acid ester, tallow fatty acid initiated polypropyleneoxide (22-24) ester-ol and $C_{12-15}$ alcohol initiated polypropyleneoxide (22-24) ether tallow fatty acid ester.

These alkoxylates can be made from the reaction of a fatty acid such as tall oil fatty acids (TOFA), that is, the mixture of fatty acids predominately oleic and linoleic and contains residual rosin acids or tallow acid that is, the mixture of fatty acids are predominately stearic, palmitic and oleic with an alcohol terminated polyether such as polypropylene glycol in the presence of an acidic catalyst, usually methane sulfonic acid. These alkoxylates can also be made from the reaction of glycerol dioleate and propylene oxide in the presence of catalyst.

Detergent

In one embodiment, the detergent can be a Mannich detergent, sometimes referred to as a Mannich base detergent. A Mannich detergent is a reaction product of a hydrocarbyl-substituted phenol, an aldehyde, and an amine or ammonia. The hydrocarbyl substituent of the hydrocarbyl-substituted phenol can have 10 to 400 carbon atoms, in another instance 30 to 180 carbon atoms, and in a further instance 10 or 40 to 110 carbon atoms. This hydrocarbyl substituent can be derived from an olefin or a polyolefin. Useful olefins include alpha-olefins, such as 1-decene, which are commercially available.

The polyolefins which can form the hydrocarbyl substituent can be prepared by polymerizing olefin monomers by well-known polymerization methods and are also commercially available. The olefin monomers include monoolefins, including monoolefins having 2 to 10 carbon atoms such as ethylene, propylene, 1-butene, isobutylene, and 1-decene. An especially useful monoolefin source is a $C_4$ refinery stream having a 35 to 75 weight percent butene content and a 30 to 60 weight percent isobutene content. Useful olefin monomers also include diolefins such as isoprene and 1,3-butadiene. Olefin monomers can also include mixtures of two or more monoolefins, of two or more diolefins, or of one or more monoolefins and one or more diolefins. Useful polyolefins include polyisobutylenes having a number average molecular weight of 140 to 5000, in another instance of 400 to 2500, and in a further instance of 140 or 500 to 1500. The polyisobutylene can have a vinylidene double bond content of 5 to 69 percent, in a second instance of 50 to 69 percent, and in a third instance of 50 to 95 percent or mixtures thereof. The polyolefin can be a homopolymer prepared from a single olefin monomer or a copolymer prepared from a mixture of two or more olefin monomers. Also, possible as the hydrocarbyl substituent source are mixtures of two or more homopolymers, two or more copolymers, or one or more homopolymers and one or more copolymers.

The hydrocarbyl-substituted phenol can be prepared by alkylating phenol with an olefin or polyolefin described above, such as a polyisobutylene or polypropylene, using well-known alkylation methods.

The aldehyde used to form the Mannich detergent can have 1 to 10 carbon atoms, and is generally formaldehyde or a reactive equivalent thereof such as formalin or paraformaldehyde.

The amine used to form the Mannich detergent can be a monoamine or a polyamine, including alkanolamines having one or more hydroxyl groups, as described in greater detail above. Useful amines include those described above, such as ethanolamine, diethanolamine, methylamine, dimethylamine, ethylenediamine, dimethylaminopropylamine, diethylenetriamine and 2-(2-aminoethylamino) ethanol. The Mannich detergent can be prepared by reacting a hydrocarbyl-substituted phenol, an aldehyde, and an amine as described in U.S. Pat. No. 5,697,988. In one embodiment, the Mannich reaction product is prepared from an alkylphenol derived from a polyisobutylene, formaldehyde, and an amine that is a primary monoamine, a secondary monoamine, or an alkylenediamine, in particular, ethylenediamine or dimethylamine.

The Mannich reaction product can be prepared by well-known methods generally involving reacting the hydrocarbyl substituted hydroxy aromatic compound, an aldehyde and an amine at temperatures between 50 to 200° C. in the presence of a solvent or diluent while removing reaction water as described in U.S. Pat. No. 5,876,468.

In yet another embodiment, the detergent can be a polyisobutylene amine. The amine use to make the polyisobutylene amine can be a polyamine such as ethylenediamine, 2-(2-aminoethylamino)ethanol, or diethylenetriamine. The polyisobutylene amine can be prepared by several known methods generally involving amination of a derivative of a polyolefin to include a chlorinated polyolefin, a hydroformylated polyolefin, and an epoxidized polyolefin. In one embodiment, the polyisobutylene amine is prepared by chlorinating a polyolefin such as a polyisobutylene and then reacting the chlorinated polyolefin with an amine such as a polyamine at elevated temperatures of generally 100 to 150° C. as described in U.S. Pat. No. 5,407,453. To improve processing, a solvent can be employed, an excess of the amine can be used to minimize cross-linking, and an inorganic base such as sodium carbonate can be used to aid in removal of hydrogen chloride generated by the reaction.

Yet another type of suitable detergent is a glyoxylate. A glyoxylate detergent is a fuel soluble ashless detergent which, in a first embodiment, is the reaction product of an amine having at least one basic nitrogen, i.e. one >N—H, and a hydrocarbyl substituted acylating agent resulting from the reaction, of a long chain hydrocarbon containing an olefinic bond with at least one carboxylic reactant selected from the group consisting of compounds of the formula (IX)

$$(R^1C(O)(R^2)_nC(O))R^3 \quad \text{(IX)}$$

and compounds of the formula (X)

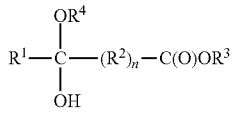

(X)

wherein each of $R^1$, $R^3$ and $R^4$ is independently H or a hydrocarbyl group, $R^2$ is a divalent hydrocarbylene group having 1 to 3 carbons and n is 0 or 1.

Examples of carboxylic reactants are glyoxylic acid, glyoxylic acid methyl ester methyl hemiacetal, and other omega-oxoalkanoic acids, keto alkanoic acids such as pyruvic acid, levulinic acid, ketovaleric acids, ketobutyric acids and numerous others. Persons of ordinary skill in the art will readily recognize the appropriate compound of formulas (VII) or (VIII) to employ as a reactant to generate a given intermediate.

The hydrocarbyl substituted acylating agent can be the reaction of a long chain hydrocarbon containing an olefin and the above described carboxylic reactant of formula (VII) and (VIII), further carried out in the presence of at least one aldehyde or ketone. Typically, the aldehyde or ketone contains from 1 to about 12 carbon atoms. Suitable aldehydes include formaldehyde, acetaldehyde, propionaldehyde, butyraldehyde, isobutyraldehyde, pentanal, hexanal, heptaldehyde, octanal, benzaldehyde, and higher aldehydes. Other aldehydes, such as dialdehydes, especially glyoxal, are useful, although monoaldehydes are generally preferred. Suitable ketones include acetone, butanone, methyl ethyl ketone, and other ketones. Typically, one of the hydrocarbyl groups of the ketone is methyl. Mixtures of two or more aldehydes and/or ketones are also useful. Compounds and the processes for making these compounds are disclosed in U.S. Pat. Nos. 5,696,060; 5,696,067; 5,739,356; 5,777,142; 5,856,524; 5,786,490; 6,020,500; 6,114,547; 5,840,920 and are incorporated herein by reference.

In another embodiment, the glyoxylate detergent is the reaction product of an amine having at least one basic nitrogen, i.e. one >N—H, and a hydrocarbyl substituted acylating agent resulting from the condensation product of a hydroxyaromatic compound and at least one carboxylic reactant selected from the group consisting of the above described compounds of the formula (VII) and compounds of the formula (VIII). Examples of carboxylic reactants are glyoxylic acid, glyoxylic acid methyl ester methyl hemiacetal, and other such materials as listed above.

The hydroxyaromatic compounds typically contain directly at least one hydrocarbyl group R bonded to at least one aromatic group. The hydrocarbyl group R may contain up to about 750 carbon atoms or 4 to 750 carbon atoms, or 4 to 400 carbon atoms or 4 to 100 carbon atoms. In one embodiment, at least one R is derived from polybutene. In another embodiment, R is derived from polypropylene.

In another embodiment, the reaction of the hydroxyaromatic compound and the above described carboxylic acid reactant of formula (VII) or (VIII) can be carried out in the presence of at least one aldehyde or ketone. The aldehyde or ketone reactant employed in this embodiment is a carbonyl compound other than a carboxy-substituted carbonyl compound. Suitable aldehydes include monoaldehydes such as formaldehyde, acetaldehyde, propionaldehyde, butyraldehyde, isobutyraldehyde, pentanal, hexanal, heptaldehyde, octanal, benzaldehyde, and higher aldehydes. Other aldehydes, such as dialdehydes, especially glyoxal, are useful. Suitable ketones include acetone, butanone, methyl ethyl ketone, and other ketones. Typically, one of the hydrocarbyl groups of the ketone is methyl. Mixtures of two or more aldehydes and/or ketones are also useful. Compounds and the processes for making these compounds are disclosed in U.S. Pat. Nos. 3,954,808; 5,336,278; 5,620,949 and 5,458,793 and are incorporated herein by reference.

The detergent additive can be present in a mixture of various detergents referenced above. In one embodiment, the detergent additive can be present in the additive composition at about 3 to about 60% by weight, or from about 3 to about 50% by weight, or from about 3 to about 20% weight by weight, or from about 10 to about 20% by weight.

The detergent additive can be present in a fuel composition in one embodiment on a weight basis at 1 to 10,000 ppm (parts per million), and in other embodiments can be present at 10 to 5,000 ppm, at 10 to 3000 ppm, at 10 to 1000, or at 10 to 600 or at 10 to 300 ppm.

Exemplary Formulations

The compound having at least one alkyl succinic acid group may be added directly to an unadditized or additized fuel. The compound having at least one alkyl succinic acid group may also be added to a fuel as part of an additive concentrate, or additive package. Exemplary additive packages are shown in Table 1 below.

TABLE 1

| | Additive Packages (wt %) | | |
|---|---|---|---|
| Additive | A | B | C |
| Disclosed compound having at least one alkyl succinic acid group | 0.1 to 20 | 0.5 to 15 | 1 to 10 |
| Friction Modifier (optional) | 0.1 to 20 | 0.5 to 15 | 1 to 10 |
| Organic Solvent (xylene) | 0 to 70 | 0 to 50 | 0 to 40 |
| Organic Solvent (2-ethylhexanol) | 0 to 40 | 0 to 30 | 0 to 20 |
| Organic Solvent (HAN) | 0 to 40 | 0 to 35 | 0 to 30 |
| Fluidizer (polyether) | 0 to 40 | 0 to 30 | 0 to 20 |
| Detergent (polyetheramine) | 0 to 70 | 0 to 50 | 0 to 30 |
| Detergent (Mannich) | 0 to 70 | 20 to 60 | 30 to 50 |
| Detergent (PIB-amine) | 0 to 70 | 20 to 60 | 30 to 50 |
| Demulsifier (polyalkoxylated alcohol) | 0 to 5 | 0 to 3 | 0 to 1 |
| Corrosion Inhibitor (PIB-succinic acid) | 0 to 3 | 0 to 2 | 0 to 1 |
| Total (total of the above additives)* | 100 | 100 | 100 |

*Persons of ordinary skill in the art will understand that the amount of each additive for an additive package will be selected such that the total will equal 100% even if the ranges listed in the table may not equal 100%.

The fuel compositions may be prepared by combining the fuel, additives, and/or oxygenates prior to putting the fuel in a vehicle. For example, the compound may be added and mixed together with a fuel at concentrations of at least 10 ppm. The additized fuel may then be pumped into the fuel tank. In other embodiments, the fuel may be added to the fuel tank of a vehicle and the compound may be added to a separate dosing tank in the vehicle. The compound may then be dosed to the fuel at concentrations of at least 10 ppm as the vehicle is operating. This is known as "onboard dosing".

The amount of each chemical component described is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials which are normally understood to be present in the commercial grade.

It is known that some of the materials described above may interact in the final formulation, so that the components of the final formulation may be different from those that are initially added. The products formed thereby, including the products formed upon employing the compositions disclosed herein may not be susceptible of easy description. Nevertheless, all such modifications and reaction products are included within the scope of the disclosed technology, including compositions prepared by admixing the components described above.

INDUSTRIAL APPLICATION

In one embodiment the fuel compositions described above are useful for liquid fuel engines and/or for spark ignited engines and can include engines for hybrid vehicles and stationary engines. The type of engine is not overly limited. The engine may be a carbureted or fuel injected gasoline engine. As such, the engine may have a carburetor or injectors. In one embodiment, the engine may be a gasoline direct injection ("GDI") engine, a port fuel injection ("PFI") engine, a homogeneous charge compression ignition ("HCCI") engine, or a combination thereof, such as an engine that contains both GDI and PFI injectors in the same engine. Suitable GDI/PFI engines includes 2-stroke or 4-stroke engines fueled with gasoline, a mixed gasoline/alcohol or any of the fuel compositions described in the sections above. The additive composition can reduce wear in, and/or improve fuel economy of, an engine, such as a GDI/PFI engine. In yet other embodiments, the fuel compositions may be prepared using an on-board dosing system for either a GDI engine, a PFI engine, or a combination thereof.

The fuel compositions described above may be used to reduce carbonaceous deposits in an engine operated on the fuel. The compound may be present in the fuel composition in an amount of at least 10 ppm, 12 ppm, 25 ppm, or 50 ppm to 100 ppm, 500 or 2500 ppm, based on a total weight of the fuel composition.

The disclosed technology may be further illustrated by the following examples.

EXAMPLES

The compound having at least one alkyl succinic acid group are added to different samples of unadditized gasoline.

The performance of each fuel is then tested in a GDI engine. The tests utilize a 2013 GM 2.0L ECOTEC turbo LHU GDI engine. The GM Ecotec engine is operated at 2000 rpm and 22.0 bar BMEP with an oil sump temperature of 100° C. The test consists of nine phases of 15,000 combustion cycles with each phase separated by an idle period. Thus, combustion events are counted over 135,000 combustion cycles.

LSPI events are determined by monitoring peak cylinder pressure (PP) and mass fraction burn (MFB) of the fuel charge in the cylinder. When both criteria are met, it is determined that an LSPI event has occurred. The threshold for peak cylinder pressure is typically 9,000 to 10,000 kPa. The threshold for MFB is typically such that at least 2% of the fuel charge is burned late, i.e. 5.5 degrees After Top Dead Center (ATDC). LSPI events can be reported as events per 100,000 combustion cycles, events per cycle, and/or combustion cycles per event. The number of SPI events are measured for each fuel.

Other LSPI testing options are not limited to but may include the Sequence IX Ford LSPI engine test stand. The Ford Ecoboost engine is operated in two stages. In the first stage, the engine is operated at 1500 rpm and 14.4 bar break mean effective pressure (BMEP). During the second stage, the engine is operated at 1750 rpm and 17.0 bar BMEP. The engine is run for 25,000 combustion cycles in each stage, and LSPI events are counted.

Additional LSPI testing options include, but are not limited to, Group PSA's LSPI engine test stands (EB2 or EP6), any other modified turbocharged or supercharged engine stand, and/or on-road vehicles with diagnostic equipment to measure LSPI related engine parameters.

Each of the documents referred to above is incorporated herein by reference, including any prior applications, whether or not specifically listed above, from which priority is claimed. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the invention can be used together with ranges or amounts for any of the other elements.

As used herein, the transitional term "comprising," which is synonymous with "including," "containing," or "characterized by," is inclusive or open-ended and does not exclude additional, un-recited elements or method steps. However, in each recitation of "comprising" herein, it is intended that the term also encompass, as alternative embodiments, the phrases "consisting essentially of" and "consisting of," where "consisting of" excludes any element or step not specified and "consisting essentially of" permits the inclusion of additional un-recited elements or steps that do not materially affect the basic and novel characteristics of the composition or method under consideration.

While certain representative embodiments and details have been shown for the purpose of illustrating the subject invention, it will be apparent to those skilled in this art that various changes and modifications can be made therein without departing from the scope of the subject invention. In this regard, the scope of the invention is to be limited only by the following claims.

What is claimed is:

1. A method of reducing stochastic pre-ignition ("SPI") events in a gasoline-fueled engine by adding at least 10 ppm by weight of a compound having at least one alkyl succinic acid group to a gasoline fuel, wherein said compound is the product of (a) and (b), wherein:

(a) is an amine with at least one tertiary nitrogen; and (b) is a hydrocarbyl-substituted succinic acid and/or anhydride; and wherein said product has at least one of formula (II) or (III), or combinations thereof:

(II)

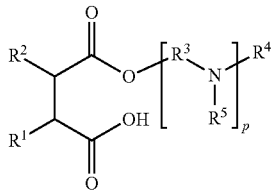

wherein $R^1$ and $R^2$ are independently hydrogen or a $C_1$ to $C_{50}$ linear or branched hydrocarbyl group; $R^3$ is $C_1$ to $C_5$ linear or branched hydrocarbyl group; $R^4$ and $R^5$ are independently hydrogen or a $C_1$ to $C_{22}$ linear or branched hydrocarbyl group, or are moieties which, when taken together form a 5-, 6-, or 7-membered ring; and p is 1 to 5;

(III)

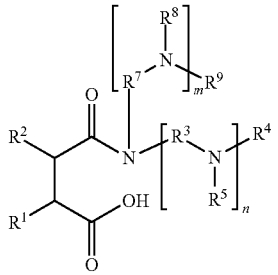

wherein $R^1$ and $R^2$ are independently hydrogen or a $C_1$ to $C_{50}$ linear or branched hydrocarbyl group; $R^3$ is a $C_1$ to $C_5$ linear or branched hydrocarbylene group; $R^4$ and $R^5$ are independently hydrogen or a $C_1$ to $C_{22}$ linear or branched hydrocarbyl group, or are moieties which, when taken together form a 5-, 6-, or 7-membered ring; n is 0 to 5; wherein $R^7$ is a $C_1$ to $C_5$ linear or branched hydrocarbylene group; $R^8$ and $R^9$ are independently hydrogen or a $C_1$ to $C_{22}$ linear or branched hydrocarbyl group, or are moieties which, when taken together form a 5-, 6-, or 7-membered ring, and m is 0 to 5, wherein at least one of m and n is not 0.

2. The method of claim 1, wherein the molar ratio of (a) to (b) ranges from 3:1 to 1:3.

3. The method of claim 1, wherein said compound of formula (II) is the product of N,N-dimethylethanolamine and hexadecenylsuccinic anhydride.

4. The method of claim 1, wherein the compound of formula (III) is the product of N1-(3-(dimenthylamino) propyl)-N3, N3-dimethylpropane-1,3-diamine and hexadecenylsuccinic anhydride.

5. The method of claim 1, wherein the amine is an alkoxylated fatty amine.

6. The method of claim 1, wherein said gasoline fuel further comprises an alkoxylated fatty amine in addition to the amine used to make said compound.

7. The method of claim 5, wherein said alkoxylated fatty amine has the formula (V):

(V)

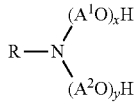

wherein R is a $C_4$ to $C_{30}$ hydrocarbyl group; $A^1$ and $A^2$ are individually a $C_1$ to $C_{10}$ alkylene group; and the sum of x and y is an integer of at least 1.

8. The method of claim 1, wherein said compound has a concentration of at least 12 ppm, 25 ppm, or 50 ppm, based on a total weight of said gasoline fuel.

9. The method of claim 1, wherein said gasoline fuel comprises 0.1 vol % to 100 vol % oxygenate, based on a total volume of said gasoline fuel.

10. The method of claim 1, wherein said gasoline fuel comprises 0.1 vol % to 100 vol % gasoline, based on a total volume of said gasoline fuel.

11. The method of claim 9, wherein said oxygenate is ethanol.

12. The method of claim 1, wherein the stochastic pre-ignition ("SPI") events are reduced to less than 20 SPI events per 100,000 combustion events.

13. The method of claim 1, wherein there is a reduction in the number of SPI events of at least 10 percent.

14. The method of claim 1, wherein said engine is an internal combustion gasoline engine.

15. The method of claim 14, wherein said internal combustion gasoline engine, is a gasoline direct injection ("GDI") engine, a port fuel injection ("PFI") engine, a homogeneous charge compression ignition ("HCCI") engine, or a combination thereof.

16. The method of claim 1, wherein said compound is added to said gasoline fuel using an onboard dosing system.

* * * * *